United States Patent [19]

Viol

[11] 4,387,640

[45] Jun. 14, 1983

[54] DEVICE FOR MARKING ARTICLES BY BRANDING

[75] Inventor: Dietmar Viol, Utting, Fed. Rep. of Germany

[73] Assignee: Fireprint AG, Heiden A-R, Switzerland

[21] Appl. No.: 316,284

[22] Filed: Oct. 29, 1981

[30] Foreign Application Priority Data

Nov. 6, 1980 [DE] Fed. Rep. of Germany ..... 3041964

[51] Int. Cl.[3] ..... B44B 7/00

[52] U.S. Cl. ..... 101/9; 101/31; 126/404

[58] Field of Search ..... 101/9–11, 101/27, 31, 35; 126/401–404

[56] References Cited

U.S. PATENT DOCUMENTS 2,177,180 10/1939 James ..... 126/402
3,946,195 3/1976 Lyons et al. ..... 101/9 X

FOREIGN PATENT DOCUMENTS 22427 8/1930 Australia ..... 126/402
2507855 9/1976 Fed. Rep. of Germany ..... 101/9

*Primary Examiner*—Clifford D. Crowder
*Attorney, Agent, or Firm*—Burgess, Ryan and Wayne

[57] ABSTRACT

For the purpose of marking an article, e.g. the fibrous surface coat of a tennis ball, by branding, there is provided a casing (1) resembling the casing of a portable lighter, said casing having disposed at one open end face (2) a symbol (5) projecting beyond two opposed casing edges (9) by an amount corresponding to the desired branding depth. Spaced from said end face (2) there is provided in said casing (1) a transverse wall (10) provided with at least one nozzle aperture (8) which is directed towards the symbol (5). Provided within said casing (1) are a liquid-gas tank (6) and an igniting mechanism (13) adapted to be actuated from the exterior of the device.

5 Claims, 7 Drawing Figures

DEVICE FOR MARKING ARTICLES BY BRANDING

TECHNICAL FIELD OF THE INVENTION

This invention relates to a device for marking articles by branding, particularly for marking the fibrous surface of a tennis ball, with the aid of at least one metallic symbol corresponding to the desired marking, said at least one symbol being attached to holding means and being adapted to be heated to the desired branding temperature by heating means.

BRIEF DESCRIPTION OF THE PRIOR ART

There have already been known tennis balls which are provided with permanent markings including symbols, numbers or letters singly or in combination, said markings being woven or vulcanized into the material or produced by a branding operation (German Utility Model Specification No. 19 52 745).

It has further been known to employ, for the purpose of branding the fibrous surface material of a tennis ball, a branding template resembling a pair of tongs, one jaw of which having the shape of a sector of a sphere and being adapted to grasp a ball to be branded, said jaw being adapted to press the ball against a branding template mounted on the other jaw of the pair of tongs. The template is heated by electric means, the result being that the template, in similarity to a cutting blade, penetrates the fibrous material and that this fibrous material is removed by a burning operation down to the inner cover of the ball so that the wear of the fibrous material during use for playing will not render the marking invisible (German Laid-Open Specification No. 28 10 653).

Such devices resembling a pair of tongs are usually available for use in factories, sales outlets or clubs where it may be desired to provide articles with markings, but in most cases such devices are not available for an individual tennis player who may desire to put into use a new set of tennis balls or who may desire to provide with an indelible marking a certain object, for example sports shoes, balls or other articles made of cloth, plastic material, leather or wood.

OBJECT OF THE INVENTION

It is an object of this invention to provide a device of the above-mentioned kind in the form of a mass-produced article which is of extremely simple construction and easy to operate.

SUMMARY OF THE INVENTION

According to the invention, this object is attained by the provision, on the basis of the known device mentioned earlier, of a device comprising a casing resembling the casing of a cigarette lighter having one open end in which said symbol is disposed, said symbol projecting beyond two opposed casing edges by an amount corresponding to the desired depth of branding, said device further comprising a transverse will having at least one jet opening and spaced from said end face of the casing, said at least one jet opening being directed towards said symbol, there being provided in the casing a liquid-gas storage means and an igniting mechanism adapted to be actuated from the exterior of the device.

The edges of the casing defining said end face are preferably of concave curvature, such curvature, for example, conforming the shape of a tennis ball.

The device of the invention affords the advantage that its structure is equally simple as that of a lighter and that it is, therefore, possible to manufacture it as a mass-produced article. The device is extremely simple to operate. A heating period of a little more than 5 seconds is sufficient to permit marking of a surface of an article made of cloth, plastic material, leather or wood. For example, a tennis player will include such a device because of its handiness with his remaining utensils so as to have it available in the event that he desires to put into use a new set of tennis balls and considers it necessary to brand the new balls in order to prevent them from being confused with balls employed on a neighboring tennis court.

The symbol may be detachably supported from opposing casing walls by means of metallic webs or bridges. Such metallic bridges may be mounted on the casing in such a way as to be pivotable within limits so that their external faces may align themselves in the mounting aperture of the casing to conform the contour of an object to be branded. The mounting aperture may be provided in said opposing casing walls or in webs secured to the casing and extending parallel to said walls.

It is also possible to mount the symbol on a fine-meshed screen made of thin metallic wire and mounted on the casing.

The flame produced by means of the or each jet aperture provided in said transverse wall of the casing may heat the symbol either directly or by conduction of heat via the fine-meshed wire screen which latter is provided at least in the area surrounding the symbol. Upon the symbol having been heated sufficiently, for example, to a temperature between 250° and 300° C., the device is pressed against the article to be marked, e.g. a tennis ball, whereupon the heated symbol will burn a corresponding marking into the surface of the article, i.e. into the fibrous coating material of the tennis ball, marking being effected, however, to a depth only which corresponds to the amount to which the symbol projects beyond the casing edges defining the end face of the casing which is brought into contact with the article such as a tennis ball.

BRIEF DESCRIPTION OF THE DRAWINGS

The invention and further particulars will be described more specifically hereinafter with reference to preferred embodiments shown in the drawings, in which.

DETAILED DESCRIPTION OF THE PREFERRED EMBODIMENTS OF THE INVENTION

Figure 2:
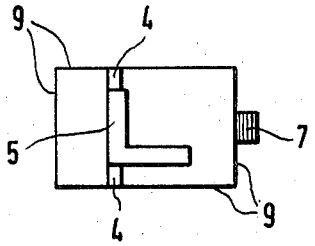
FIG. 2 is a plan view of the device of FIG. 1.
Figure 1:
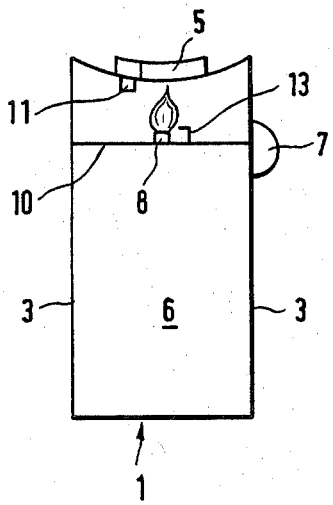
FIG. 1 is a side elevation of a first embodiment of a device according to the invention.
Figure 3:
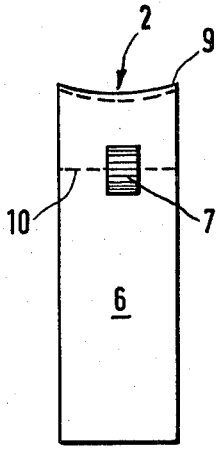
FIG. 3 is an end view of the device of FIG. 1.

The device shown in FIGS. 1 to 3 is adapted to brand the fibrous surface coat of a tennis ball. It includes a casing 1 of parallelepiped shape of which the lateral walls 3 project beyond a transverse wall 10 and terminate in edges 9 defining an end face 2 of concave shape matching the spherical shape of a tennis ball. The interior 6 of casing 1 defined by lateral walls 3, a bottom and transverse wall 10 encloses a refillable liquid-gas storage tank of the type employed in a lighter. The liquid-gas tank is connected by means of a discharge valve (not shown) to a nozzle 8 mounted in transverse wall 10, said nozzle being directed towards end face 2. The discharge valve of nozzle 8 and the igniting mechanism 13 are actuated by means of a sliding knob or wheel 7 carried in one of casing side walls 3.

Figure 4:
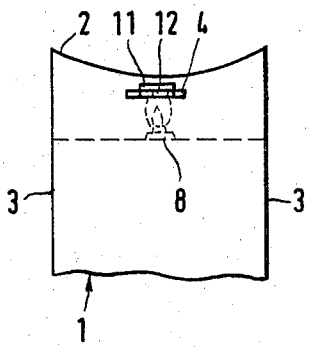
FIG. 4 is a diagrammatic showing of the manner in which a metallic bridge member is pivotally mounted in the casing of the device shown in FIG. 1.

The edge portions of two opposed lateral walls 3 are provided with recesses 11 permitting clamping in position of metallic bridge members 4 carrying a symbol 5 which, in the example shown in FIG. 2, has the shape of the letter L. As shown in FIG. 4, metallic bridge member 4 is provided on either end with a projection 12, the cross-section of which is smaller than the area of each recess 11. This way of supporting the bridge member permits the symbol 5 secured thereto to be tilted and thus to be aligned with the surface to be marked.

Actuation of sliding knob 7 causes the discharge valve of nozzle 8 to be opened and igniting mechanism 13 to be operated, this, in turn, causing a spark to be produced e.g. by piezoelectric means so as to ignite the gas. After symbol 5 has been heated sufficiently by the gas flame, this being the case after approximately 5 to 10 seconds, the tennis ball is forced against symbol 5, the result being that the fibrous coating of the tennis ball is branded, this operation being, however, limited to the desired depth since the branding action is limited by the edges 9 which support the tennis ball.

Figure 6:
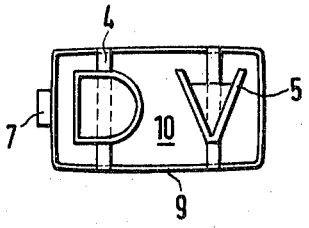
FIG. 6 is a plan view of the device of FIG. 4.
Figure 5:
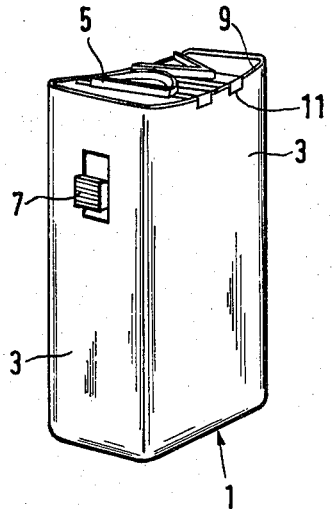
FIG. 5 is a perspective view of a second embodiment of the device of the invention.
Figure 7:
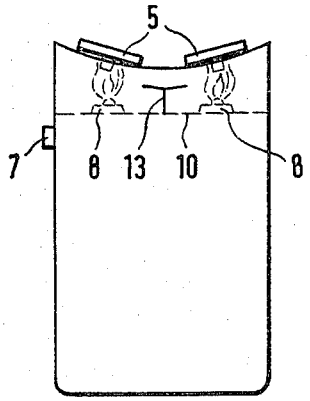
FIG. 7 is a diagrammatic lateral view of the device of FIG. 4.

In the embodiment shown in FIGS. 5 to 7, there are provided two symbols 5 in the form of letters D and V which are supported in recesses 11 of opposed side walls 3 of casing 1 in such a manner as to conform to the curvature of casing edge 9 and to project beyond edges 9. In this case, each symbol 5 has associated therewith a nozzle 8 mounted in transverse wall 10. Each nozzle 18 is provided with a discharge valve (not shown) which is adpated, together with igniting mechanism 13, to be actuated in a per se known manner by means of a sliding button 7 mounted in one of casing walls 3.

What is claimed is:

1. A hand holdable vapor fuel device for marking articles by branding, particularly for marking the fibrous surface coat of a tennis ball, by means of at least one metallic symbol corresponding to the desired marking, the symbol being supported by holding means and adapted to be heated to the branding temperature by heating means, comprising: a casing having an open end face with edges, at least one symbol disposed at an open end face of said casing, the symbol projecting beyond two opposed casing edges, in a direction away from said casing, by an amount corresponding to the desired depth of branding, said casing being provided with a transverse wall, spaced from said open end face of said casing, said wall being provided with at least one nozzle aperture, comprising a burner of said heating means, directed towards said symbol, said casing containing a liquified gas tank and valve means in communication with said nozzle aperture, and an igniting mechanism for igniting gas issuing from said nozzle aperture and means for actuating said valve means and igniting mechanism from the exterior of the device.

2. A device of claim 1 wherein the casing edges defining said end face of the casing have a concave curvature.

3. A device of claim 1 or claim 2 wherein said symbol is detachably supported from opposed casing walls by means of metallic bridge members.

4. A device of claim 3 wherein said metallic bridge members are supported by said casing in such a manner as to be pivotable within limits.

5. A device of claim 3 wherein said symbol is attached to a fine-meshed screen made of thin metallic wire and attached to said casing.

* * * * *